US007380589B2

(12) United States Patent
Martin et al.

(10) Patent No.: US 7,380,589 B2
(45) Date of Patent: Jun. 3, 2008

(54) SUBSEA COILED TUBING INJECTOR WITH PRESSURE COMPENSATION

(75) Inventors: David Wayne Martin, Harris County, TX (US); Ronald W. Yater, Harris County, TX (US)

(73) Assignee: Varco Shaffer, Inc., Houston, TX (US)

( * ) Notice: Subject to any disclaimer, the term of this patent is extended or adjusted under 35 U.S.C. 154(b) by 906 days.

(21) Appl. No.: 10/730,792

(22) Filed: Dec. 9, 2003

(65) Prior Publication Data

US 2005/0224224 A1 Oct. 13, 2005

Related U.S. Application Data

(60) Provisional application No. 60/433,259, filed on Dec. 13, 2002.

(51) Int. Cl.
*E21B 19/22* (2006.01)

(52) U.S. Cl. ..... 166/77.3

(58) Field of Classification Search ..... 166/338, 166/339, 340, 341, 343, 77.3
See application file for complete search history.

(56) References Cited

U.S. PATENT DOCUMENTS

| | | | | |
|---|---|---|---|---|
| 3,182,877 | A | 5/1965 | Slator et al. | |
| 4,899,823 | A | 2/1990 | Cobb et al. | |
| 4,943,187 | A | 7/1990 | Hopper | 405/190 |
| 5,778,981 | A | 7/1998 | Head | 166/345 |
| 5,890,534 | A | 4/1999 | Burge et al. | 166/77.3 |
| 6,006,839 | A | 12/1999 | Dearing et al. | 166/384 |
| 6,042,303 | A | 3/2000 | Head | 405/195.1 |
| 6,053,252 | A | 4/2000 | Edwards | 166/348 |
| 6,102,125 | A | 8/2000 | Calder | 166/359 |
| 6,116,345 | A | 9/2000 | Fontana et al. | 166/343 |
| 6,182,765 | B1 | 2/2001 | Kilgore | 166/381 |
| 6,276,454 | B1 | 8/2001 | Fontana et al. | 166/343 |
| 6,386,290 | B1 | 5/2002 | Headworth | 166/346 |
| 6,460,621 | B2 | 10/2002 | Fenton et al. | 166/347 |
| 6,659,180 | B2 | 12/2003 | Moss | 166/339 |
| 6,698,520 | B2 | 3/2004 | Fenton et al. | 166/347 |
| 6,763,889 | B2 | 7/2004 | Rytlewski et al. | 166/338 |
| 6,808,021 | B2 | 10/2004 | Zimmerman et al. | 166/381 |
| 6,834,724 | B2 | 12/2004 | Headworth | 166/384 |
| 7,165,619 | B2 * | 1/2007 | Fox et al. | 166/343 |
| 2003/0000740 | A1 | 1/2003 | Haynes et al. | 175/57 |
| 2003/0155127 | A1 | 8/2003 | Carlsen | 166/368 |
| 2004/0094305 | A1 | 5/2004 | Skjaerseth et al. | 166/339 |

* cited by examiner

*Primary Examiner*—William P Neuder
(74) *Attorney, Agent, or Firm*—Guy McClung

(57) ABSTRACT

A pressure compensated tubing injector for injecting coiled tubing into a subsea wellhead or flowline. A traction device including grippers carried on respective opposing chain loops provides gripping engagement with the coiled tubing to longitudinally move the coiled tubing. A plurality of sealed outboard bearing assemblies guide movement of the chain loops. A drive unit powers the chain loops and includes a sealed gear case. One or more pressure compensators are placed in communication with the sealed gear case and one or more of the bearing assemblies, to compensate for subsea pressure and prevent intrusion of seawater. The bearing assemblies may include self-contained pressure compensators.

20 Claims, 4 Drawing Sheets

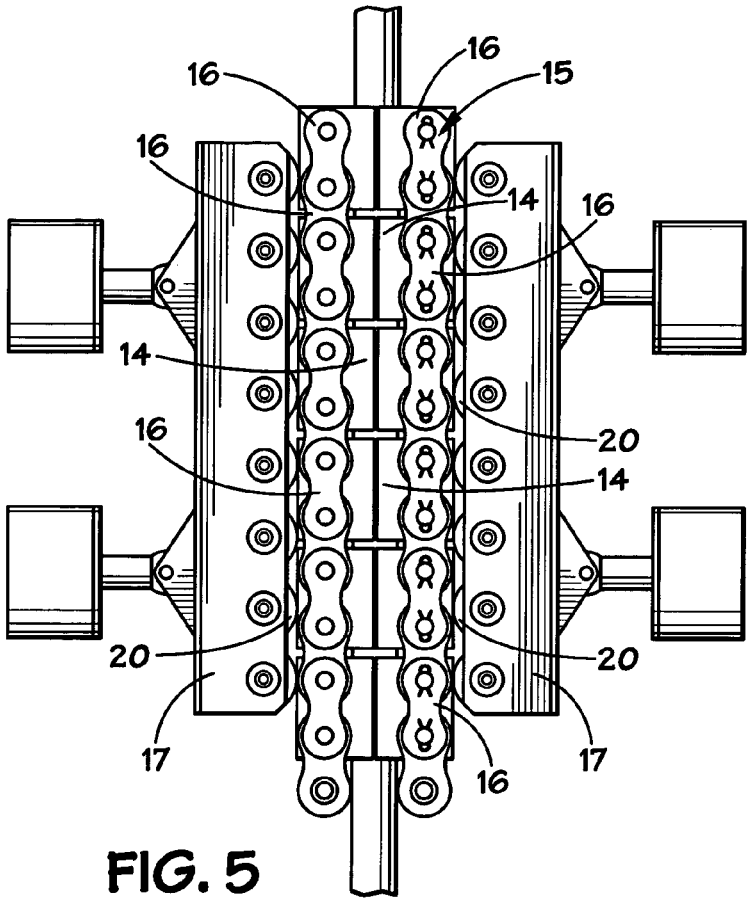
FIG. 5
FIG. 6
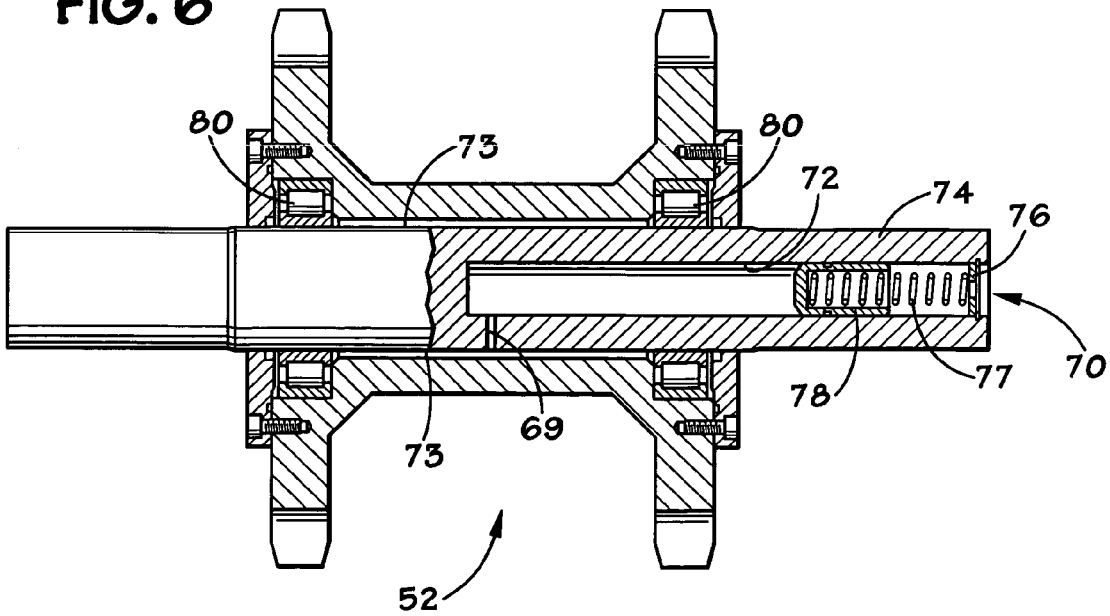

SUBSEA COILED TUBING INJECTOR WITH PRESSURE COMPENSATION

RELATED CASE

This application claims priority from U.S. Ser. No. 60/433,259 filed Dec. 13, 2002.

FIELD OF THE INVENTION

The invention relates to a subsea coiled tubing injector and, more particularly, to a subsea injector with a pressure compensated drive system.

BACKGROUND OF THE INVENTION

Coiled tubing has been used for decades in land-based hydrocarbon recovery operations to perform various well treatment, stimulation, injection, and recovery functions more efficiently than with threaded tubulars. In a conventional land-based operation, the coiled tubing injector may use a gear drive mechanism with conventional bearing assemblies to reliably and efficiently transmit power to the coiled tubing.

While conventional coiled tubing injectors may work satisfactorily for land-based or shallow-water operations, they would not work in deeper water because the drive mechanism for the injector is not sufficiently protected from the subsea environment. Specifically, the hydrostatic pressure at such depths is sufficient to penetrate past the seals used on lubricated components such as the gear case and bearing assemblies of land-based equipment. A proposed solution to this problem is disclosed in U.S. Pat. No. 4,899,823, whereby the tubing injector is protected subsea by an enclosure surrounding substantially the entire tubing injector. Seals are provided between the enclosure and the coiled tubing above and below the injector. An obvious disadvantage of this solution is the size of the housing and complexity of enclosing the entire injector with the housing.

An improved coiled tubing injector for subsea use is therefore desirable.

SUMMARY OF THE INVENTION

A pressure-compensated tubing injector is disclosed for injecting coiled tubing into a subsea wellhead or flowline. The injector comprises a traction device including a plurality of opposing grippers carried on respective opposing chain loops for gripping engagement with the coiled tubing and longitudinally movable with the coiled tubing. A plurality of outboard bearing assemblies guide movement of the opposing chain loops. The bearing assemblies may comprise first and second pairs of bearing assemblies, each pair for guiding movement of a respective one of the opposing chain loops. A drive unit powers the opposing chain loops to move the chain loops and the grippers carried thereon. The drive unit includes a sealed gear case. A pressure compensator in communication with the sealed gear case is responsive to subsea pressure, such that pressure within the sealed gear case is functionally related to subsea pressure.

The pressure compensator may be placed in communication with one or more of the outboard bearing assemblies, such that pressure within the one or more compensated outboard bearing assemblies is functionally related to subsea pressure.

The pressure compensator may comprise a compensator housing structurally separate from the gear case and bearing assemblies and having a sealed internal cavity in communication with the sealed gear case. A movable element within the compensator housing is responsive to subsea pressure for varying a volume of the internal cavity. A biasing member may be included for biasing the movable element, preferably to increase pressure.

Conduit may extend between the pressure compensator and the sealed gear case for placing the pressure compensator in fluid communication with the sealed gear case. Conduit may also extend between the pressure compensator and the one or more outboard bearing assemblies, for placing the pressure compensator in "direct" fluid communication with the bearing assemblies. Conduit may alternatively extend between the sealed gear case and the one or more outboard bearing assemblies, for placing the pressure compensator in "indirect" fluid communication with the bearing assemblies.

The bearing assemblies may each comprise a self-contained a pressure compensator. A movable element is within a bore of a bearing shaft, and the bore is in fluid communication with a bearing cavity containing a lubricant within the bearing assemblies. The movable element is exposed on an inner surface to the lubricant and on an outer surface to subsea pressure.

DESCRIPTION OF THE DRAWINGS

FIG. 5 is an enlarged view of an alternate embodiment of the traction system, wherein the rollers are secured to the support members, and the chain rides along the rollers.

FIG. 6 shows a bearing assembly having a self-contained pressure compensator having a piston movable within a bore of a shaft.

DETAILED DESCRIPTION OF THE PREFERRED EMBODIMENTS

Figure 2:
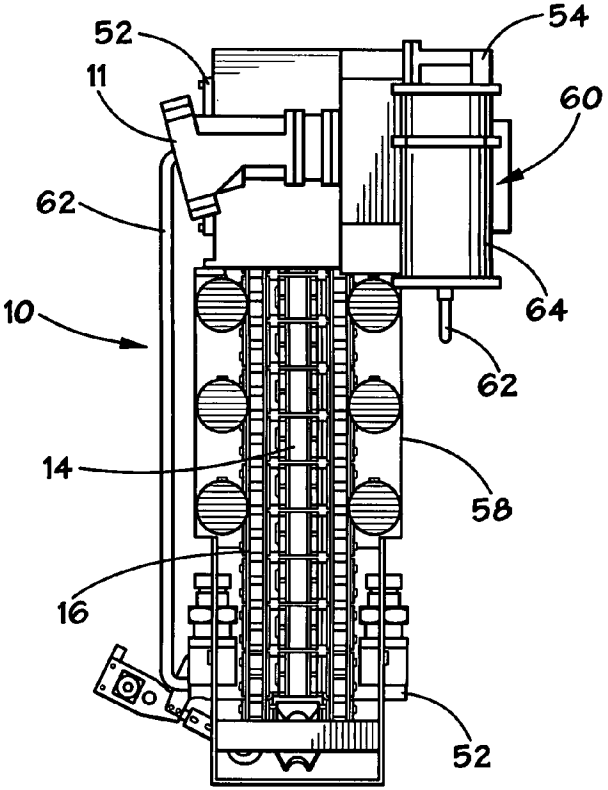
FIG. 2 is a side view of the injector shown in FIG. 1.
Figure 1:
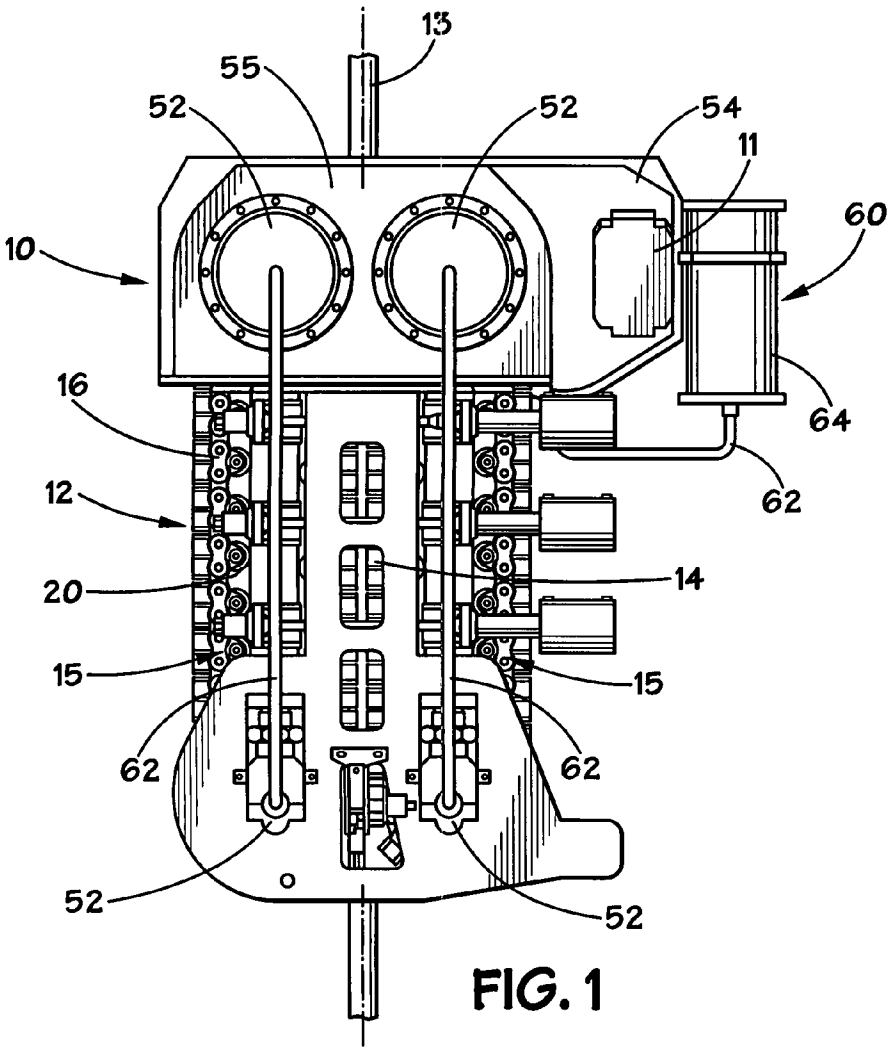
FIG. 1 is a front view of a coiled tubing injector according to the present invention.

FIG. 1 shows a coiled tubing injector 10 for use in a subsea environment. FIG. 2 is a side view of the injector 10 shown in FIG. 1. The injector 10 uses a traction assembly 12, shown more closely in FIG. 4, to engage the coiled tubing 13 and drive the coiled tubing 13 into or out of a well (not shown). The traction assembly 12 comprises opposing chain loops 15 guided by bearing assemblies 52. Gripping members 14 are secured to individual links 16 of the chain loops 15, so as to grip the coiled tubing 13. The gripping members 14 and the chain loops 15 thus move together longitudinally at the area of contact with the coiled tubing 13, to move the coiled tubing 13 into or out of the well.

Figure 4:
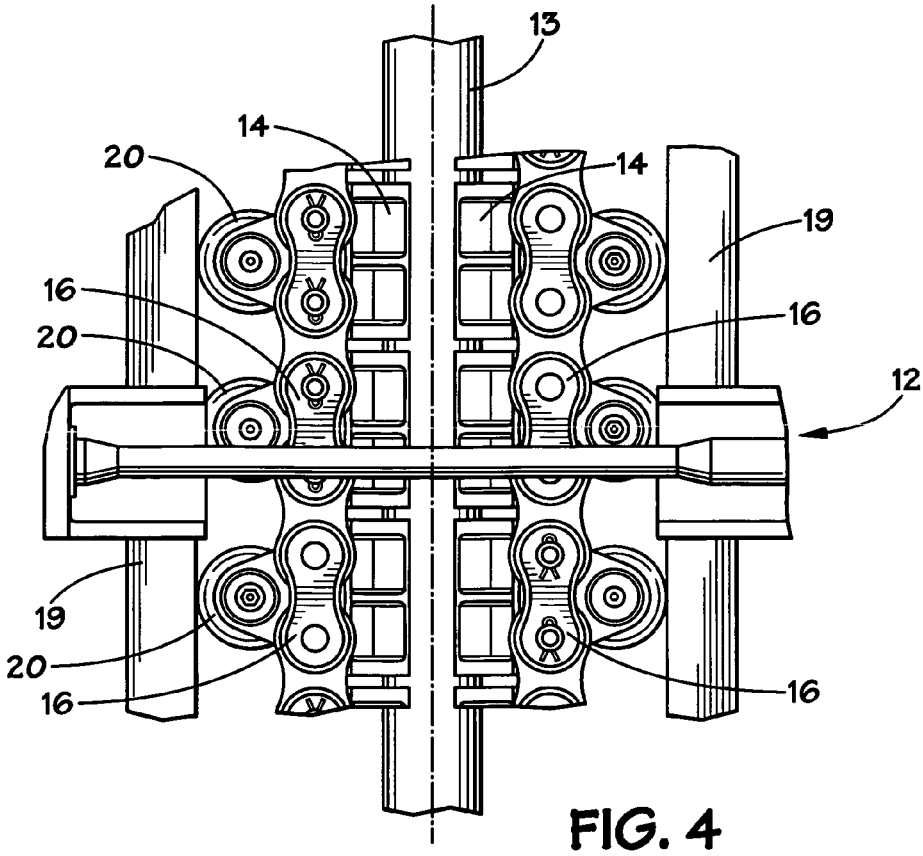
FIG. 4 is an enlarged view of the traction system of the injector shown in FIG. 1, wherein the rollers are secured to the chain and ride along the support members.

A plurality of rollers 20, as shown in FIG. 1 and more closely in FIG. 4, are secured to the links 16 of the chain loops 15, and roll along support members 19. The support members 19 are moved laterally inwardly to urge the gripping members 14 into engagement with the coiled tubing 13 with sufficient force to grip the coiled tubing 13. The rollers 20 allow for a large lateral load to be applied, preferably without inducing a significant longitudinal drag load. FIG. 5 illustrates an alternate design, whereby the rollers 20 are instead secured to support members 17, and the chain loops 15 instead ride along and move relative to the rollers 20.

The bearing assemblies 52 and an injector gear case 54 as shown in FIG. 1 are both preferably sealed to retain lubricant and prevent intrusion of sea water. The bearing assemblies 52 are preferably outboard bearing assemblies, because the portion of the housing 55 adjacent the sealed gear case 54 may be open to seawater to accommodate the chain loops 15. The chain loops 15 are typically routed over sprockets or gears (not shown) within the housing 55, rotating about the axis of the bearings assemblies 52, and the chain loops 15 are thus guided by the bearing assemblies 52. A drive motor 11 drives the chain loops 15, and is preferably hydraulically powered or possibly electrically powered. The gear case 54 may transmit energy from the drive motor 11 to the chain loops 15 using a plurality of gears within the gear case 54 and a drive shaft (not shown) sealably extending from the sealed gear case 54.

Figure 3:
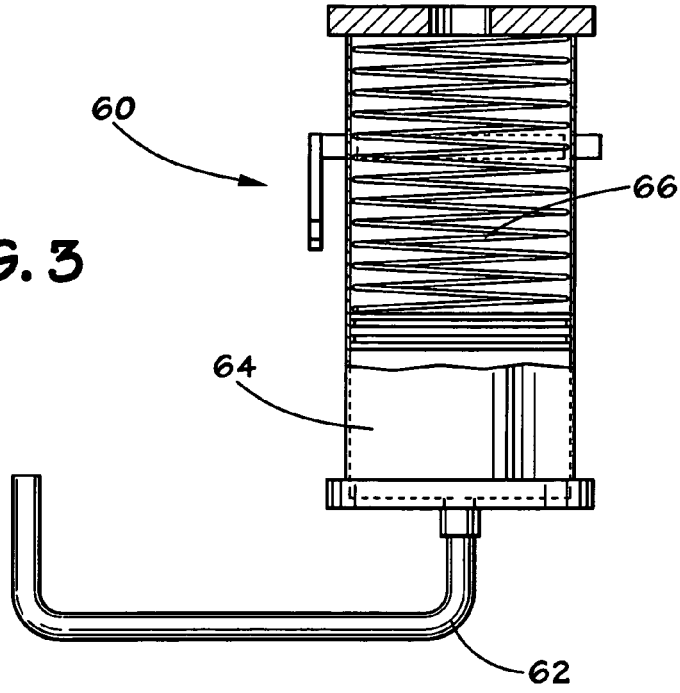
FIG. 3 is a pictorial view of a suitable pressure compensator shown in FIG. 1.

A commercially-available pressure compensator 60 is conceptually shown assembled with the injector 10 in FIG. 1, and illustrated more closely in FIG. 3. The pressure compensator 60 compensates pressure within the gear case 54, and may also compensate pressure within each outboard bearing assembly 52 and other components of the injector 10 that are sealed and sensitive to pressure differentials, such as the rollers 20. The pressure compensator 60 may include a compensator housing 64 structurally separate from and attached to a portion of the injector 10 such as the outer housing of the gear case 54. Lubricant is contained within the housing 64, which is sealed from seawater. Conventional tubing or other conduit 62 may be used to fluidly connect and pass lubricant between the pressure compensator 60 and the gear case 54, the bearing assemblies 52, the rollers 20, and other sealed components. A piston or diaphragm indicated schematically by a movable element 66 is movable with respect to the housing 64. According to basic physics, the pressure on a surface of the movable element 66 is substantially equal to the hydrostatic pressure. As the hydrostatic pressure surrounding the pressure compensator 60 increases, such as when the injector 10 is lowered into a subsea environment, the movable element 66 moves inwardly with respect to the housing 64. This increases the internal pressure of the compensator 60 and of the sealed components plumbed therewith, such as the gear case 54, the bearing assemblies 52, and the rollers 20. Accordingly, this reduces the pressure differential that would otherwise exist between the seawater environment and the interior of the sealed components. Ideally, air from the enclosed volumes of the sealed components is evacuated and replaced by the lubricant prior to deployment of the injector 10, to ensure the reliable transfer of lubricant in response to movement of the movable element 66.

The external pressure compensator 60 may be plumbed to the gear case 54 via conduit 62 to place the pressure compensator 60 in communication with the gear case 54. The bearing assemblies 52 may then be placed either in "direct" communication with the pressure compensator 60 by plumbing directly between the pressure compensator 60 and bearing assemblies 52, or "indirect" communication by plumbing from the gear case 54 to the bearing assemblies 52. Alternatively, multiple external compensators (not shown) may be used to plumb to selected components. For example, one compensator 60 may be plumbed to the gear case 54, and directly or indirectly to the two upper bearing assemblies 52 closer to the gear case 54, and another compensator (not shown) may be positioned more closely and plumbed to the lower bearing assemblies 52 further from the gear case 54.

Figure 7:
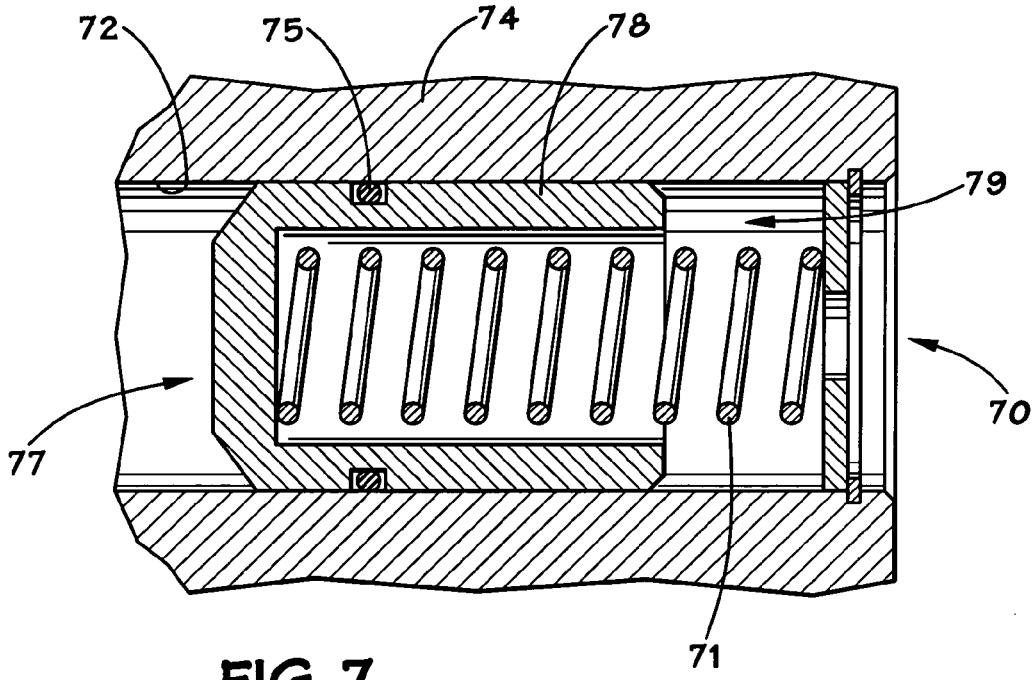
FIG. 7 shows a cutaway of the built-in pressure compensator of FIG. 6.

Instead of plumbing an external compensator to the bearing assemblies 52, the bearing assemblies 52 may include a self-contained pressure compensator 70 within a bore 72 of a shaft 74, as shown conceptually in FIG. 6 and in closer detail in a cutaway view of FIG. 7. A piston 78 is sealed with the shaft bore 72 by a sealing member, which may be an o-ring 75. The bore 72 is in fluid communication with a lubricant-containing bearing cavity 73 via flow passageway 69. An optional spring 71 is secured adjacent an outer side 79 of the piston exposed to the subsea environment, and is secured at one end to the shaft 74 with a plate 76 or other securing member. The spring 71 selectively biases the piston 78 inwardly or outwardly. Preferably, the spring 71 biases the piston 78 inwardly to compress the volume of the bore 72 and cavity 73, which results in an overbalancing pressure on the lubricant in the bearing cavity 73. The pressure overbalancing further protects against intrusion of seawater into the bearing cavity 73 and bearings 80, by offsetting the oppositely-directed subsea pressure attempting to infiltrate into the sealed cavity 73.

Figure 8:
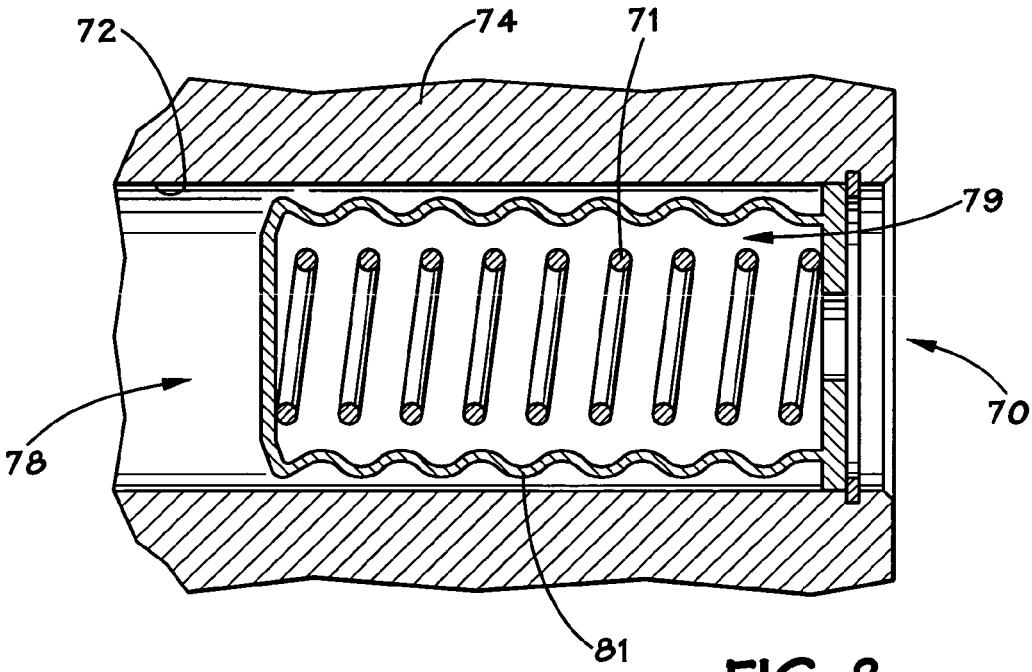
FIG. 8 shows a cutaway of an alternate embodiment of the built-in pressure compensator using a diaphragm instead of a piston.

The cutaway view of FIG. 8 shows a less preferred embodiment of the pressure compensator 70 of FIGS. 6 and 7. A flexible diaphragm 81 is used instead of the piston 78 within the bore 72 of the shaft 74. The optional spring 71 biases the diaphragm 81 as it did the piston 78.

The coiled tubing injector of this invention is not limited to downhole recovery operations. For example, the tubing injector may also be used to perform pipeline maintenance operations. The pipeline version of the coiled tubing injector may be landed on the seabed and attached to an access valve in the pipeline using a lightweight connector. The pressure control system may consist of a gate valve a shear ram, and a set of strippers. Tools and/or fluid may then be conveyed in and out of the pipeline using the coiled tubing. Because the coiled tubing may be used to pull the tools back from where they were launched, there is no need for a pigging loop. The use of coiled tubing also allows various fluids to be pumped into the pipeline, which would be especially beneficial for removing sand or paraffin.

Although specific embodiments of the invention have been described herein in some detail, it is to be understood that this has been done solely for the purposes of describing the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from the spirit and scope of the invention.

The invention claimed is:

1. A tubing injector for injecting coiled tubing into a subsea wellhead or flowline, comprising:

a traction device including a plurality of opposing grippers carried on respective opposing chain loops for gripping engagement with the coiled tubing and longitudinally movable with the coiled tubing;

a plurality of outboard bearing assemblies for guiding movement of the opposing chain loops;

a drive unit for powering the opposing chain loops to move the chain loops and the grippers carried thereon, the drive unit including a sealed gear case; and a pressure compensator in communication with the sealed gear case, the pressure compensator responsive to subsea pressure, such that pressure within the sealed gear case is functionally related to subsea pressure.

2. A tubing injector as defined in claim 1, further comprising: the pressure compensator being in communication with one or more of the outboard bearing assemblies, such that pressure within the one or more compensated outboard bearing assemblies is functionally related to subsea pressure.

3. A tubing injector as defined in claim 1, wherein the pressure compensator further comprises:

a compensator housing structurally separate from the gear case and bearing assemblies and having a sealed internal cavity in communication with the sealed gear case;

a movable element within the compensator housing responsive to subsea pressure for varying a volume of the internal cavity; and a biasing member for biasing the movable element.

4. A tubing injector as defined in claim 3, wherein the biasing member biases the movable element to increase pressure.

5. A tubing injector as defined in claim 1, further comprising: a conduit extending between the pressure compensator and the sealed gear case for placing the pressure compensator in fluid communication with the sealed gear case.

6. A tubing injector as defined in claim 2, further comprising: a conduit extending between the pressure compensator and the one or more outboard bearing assemblies, for placing the pressure compensator in direct fluid communication with the bearing assemblies.

7. A tubing injector as defined in claim 2, further comprising: a conduit extending between the sealed gear case and the one or more outboard bearing assemblies, for placing the pressure compensator in indirect fluid communication with the bearing assemblies.

8. A tubing injector as defined in claim 1, wherein the plurality of bearing assemblies further comprises: first and second pairs of bearing assemblies, each pair for guiding movement of a respective one of the opposing chain loops.

9. A tubing injector as defined in claim 1, wherein one or more of the plurality of bearing assemblies further comprises: a pressure compensator including a movable element movable within a bore of a bearing shaft, the bore in fluid communication with a bearing cavity containing a lubricant within the bearing assemblies, the movable element exposed on an inner surface to the lubricant and on an outer surface to subsea pressure.

10. A tubing injector for injecting coiled tubing into a subsea wellhead or flowline, comprising:

a traction device including a plurality of opposing grippers carried on respective opposing chain loops for gripping engagement with the coiled tubing and longitudinally movable with the coiled tubing;

a plurality of outboard bearing assemblies for guiding movement of the opposing chain loops;

a drive unit for powering the opposing chain loops to move the chain loops and the grippers carried thereon and thereby move the coiled tubing; and a pressure compensator in communication with one or more of the plurality of bearing assemblies, such that pressure within the sealed cavities is functionally related to subsea pressure.

11. A tubing injector as defined in claim 10, wherein the pressure compensator comprises:

a compensator housing structurally separate from the plurality of outboard bearing assemblies and having a sealed internal cavity in communication with the one or more of the outboard bearing assemblies; and a movable element within the internal cavity responsive to subsea pressure for varying a volume of the internal cavity.

12. A tubing injector as defined in claim 11, wherein the pressure compensator further comprises: a biasing member for biasing the movable element.

13. A tubing injector as defined in claim 10, wherein one or more of the plurality of bearing assemblies further comprises: the pressure compensator includes a movable element movable within a bore of a bearing shaft, the bore in fluid communication with a bearing cavity containing a lubricant within a bearing assembly, the movable element exposed on an inner surface to the lubricant and on an outer surface to subsea pressure.

14. A tubing injector as defined in claim 13, wherein the movable element comprises: one of a piston and a diaphragm sealed with the bore of the bearing shaft.

15. A tubing injector for injecting coiled tubing into a subsea wellhead or flowline, comprising:

a traction device including a plurality of opposing grippers carried on respective opposing chain loops for gripping engagement with the coiled tubing and longitudinally movable with the coiled tubing;

two pairs of outboard bearing assemblies, each pair for guiding movement of a respective chain loop;

a drive unit for powering the opposing chain loops to move the chain loops and the grippers carried thereon, the drive unit including a sealed gear case; and one or more pressure compensators in communication with the sealed gear case and each of the pairs of outboard bearing assemblies, the one or more pressure compensators responsive to pressure of the subsea environment, such that pressure within the sealed gear case and the bearing assemblies is functionally related to subsea pressure.

16. A tubing injector as defined in claim 15, wherein one or more of the pressure compensators comprises:

a compensator housing structurally separate from the gear case and bearing assemblies and having a sealed internal cavity in communication with the sealed gear case; and a movable element within the internal cavity responsive to subsea pressure for varying the internal pressure.

17. A tubing injector as defined in claim 16, further comprising: a spring for biasing the movable element to increase the internal pressure.

18. A tubing injector as defined in claim 15, wherein one or more of the pressure compensators further comprises: a pressure compensator including a movable element axially movable within a bore of a bearing shaft, the bore in fluid communication with a bearing cavity containing a lubricant within the bearing assemblies, the movable element exposed on an inner surface to the lubricant and on an outer surface to subsea conditions.

19. A tubing injector as defined in claim 18, wherein the movable element comprises: one of a piston and a diaphragm sealed with the bore of the bearing shaft.

20. A tubing injector as defined in claim 15, wherein air within the one or more pressure compensators, the sealed gear case, the bearing assemblies, and passageways therebetween is substantially evacuated and replaced with lubricant, such that the one or more pressure compensators may control pressure on the lubricant to be greater than, less than, or substantially equal to subsea pressure.

* * * * *